US011091926B1

(12) United States Patent
Liu et al.

(10) Patent No.: US 11,091,926 B1
(45) Date of Patent: Aug. 17, 2021

(54) BUILDING EARTHQUAKE RESISTANCE STRUCTURE AND EARTHQUAKE RESISTANCE METHOD

(71) Applicant: BEIJING NORMAL UNIVERSITY, Beijing (CN)

(72) Inventors: Jifu Liu, Beijing (CN); Yiru Jia, Beijing (CN); Jiaoyang Li, Beijing (CN); Lanlan Guo, Beijing (CN); Junming Li, Beijing (CN); Yanli Lyu, Beijing (CN); Guoming Zhang, Beijing (CN); Lianyou Liu, Beijing (CN)

(73) Assignee: BEIJING NORMAL UNIVERSITY, Beijing (CN)

( * ) Notice: Subject to any disclaimer, the term of this patent is extended or adjusted under 35 U.S.C. 154(b) by 0 days.

(21) Appl. No.: 17/267,333

(22) PCT Filed: Sep. 26, 2018

(86) PCT No.: PCT/CN2018/107437

§ 371 (c)(1),
(2) Date: Feb. 9, 2021

(87) PCT Pub. No.: WO2019/042481

PCT Pub. Date: Jul. 3, 2019

(51) Int. Cl.

| | |
|---|---|
| ***E04H 9/02*** | (2006.01) |
| ***E04B 7/02*** | (2006.01) |
| ***E04B 1/36*** | (2006.01) |

(52) U.S. Cl.
CPC ..... *E04H 9/023* (2013.01); *E04B 1/36* (2013.01); *E04B 7/022* (2013.01); *E04H 9/021* (2013.01); *E04H 9/0215* (2020.05)

(58) Field of Classification Search
CPC ..... E04H 9/06; E04H 9/028; E04H 9/021; E04H 9/023; E04H 9/0215; E04H 9/0235;
(Continued)

(56) References Cited

U.S. PATENT DOCUMENTS 2,035,009 A * 3/1936 Rager ..... E04H 9/021 52/167.4
2,055,000 A * 9/1936 Bacigalupo ..... E04H 9/023 52/167.6

(Continued)

FOREIGN PATENT DOCUMENTS

CH 296591 A * 2/1954 ..... E04B 1/36
CN 103842598 A 6/2014

(Continued)

OTHER PUBLICATIONS

International Search Report (PCT/ISA/210) issued in PCT/CN2018/107437 dated Dec. 29, 2018.

(Continued)

*Primary Examiner* — Brian D Mattei
*Assistant Examiner* — Matthew J Gitlin
(74) *Attorney, Agent, or Firm* — Birch, Stewart, Kolasch & Birch, LLP

(57) ABSTRACT

A building earthquake resistance structure includes an integrally connected roof support frame, used for supporting a roof of a building independently from walls of the building; a plurality of support columns, fixedly connected to the roof support frame; an annular trench, arranged in the ground around the building; an annular damping frame, arranged within the annular trench, lower ends of the support columns being fixedly connected to the annular damping frame; a plurality of dampers, arranged between a bottom portion of the annular trench and the annular damping frame. An earthquake resistance method for the building earthquake resistance structure prevents damage caused by the roof collapsing during an earthquake by supporting the roof of the existing building in the ground via the support columns. The building earthquake resistance structure is easy to
(Continued)

construct and suitable for transforming traditional old buildings.

15 Claims, 4 Drawing Sheets

(58) Field of Classification Search
CPC ..... E04H 9/0237; E04H 9/027; E04B 1/36; E04B 1/98; E04B 7/022; E04B 7/024
See application file for complete search history.

(56) References Cited

U.S. PATENT DOCUMENTS

| | | | | | |
|---|---|---|---|---|---|
| 5,974,743 | A * | 11/1999 | Vaia | E04H 9/02 | 52/169.6 |
| 6,088,975 | A * | 7/2000 | Wiegel | E04H 9/14 | 52/169.1 |
| 9,127,468 | B2 * | 9/2015 | Muroi | E04H 9/028 | |
| 9,976,317 | B2 * | 5/2018 | Agha Beigi | E02D 27/34 | |
| 2006/0150529 | A1 * | 7/2006 | Hogg, Jr. | E04H 9/14 | 52/3 |
| 2009/0049758 | A1 * | 2/2009 | Leonard | E04H 9/14 | 52/23 |
| 2011/0023379 | A1 * | 2/2011 | Ligas, Jr. | E04H 15/20 | 52/2.22 |
| 2012/0047822 | A1 * | 3/2012 | Zeevi | E04H 9/021 | 52/167.4 |
| 2014/0157690 | A1 | 6/2014 | Muroi | | |
| 2017/0268218 | A1 | 9/2017 | Hilton | | |
| 2020/0131794 | A1 * | 4/2020 | Panzer | E05B 65/006 | |

FOREIGN PATENT DOCUMENTS

| | | | | | |
|---|---|---|---|---|---|
| CN | 206015863 | U | | 3/2017 | |
| CN | 206034676 | U | | 3/2017 | |
| CN | 206693419 | U | | 12/2017 | |
| CN | 107740504 | A | * | 2/2018 | |
| CN | 207092339 | U | | 3/2018 | |
| CN | 112647585 | A | * | 4/2021 | |
| DE | 10353907 | A1 | * | 6/2005 | E04H 9/023 |
| JP | 2000345718 | A | * | 12/2000 | |
| JP | 2010150814 | A | * | 7/2010 | |

OTHER PUBLICATIONS

Written Opinion (PCT/ISA/237) issued in PCT/CN2018/107437 dated Dec. 29, 2018.
Chinese Office Action for Chinese Application No. 201880003839.7 dated Mar. 17, 2020, with English translation.
English translation of the Chinese Search Report for Chinese Patent Application No. 2018800038397, dated Sep. 26, 2018.

* cited by examiner

BUILDING EARTHQUAKE RESISTANCE STRUCTURE AND EARTHQUAKE RESISTANCE METHOD

FIELD OF THE INVENTION

The invention relates to disaster reduction and emergency management technologies in the field of earthquake research, in particular to the field of earthquake resistance technology about earthquake zone buildings. Specifically, the invention relates a building earthquake resistance structure and earthquake resistance method.

BACKGROUND OF THE INVENTION

An earthquake is a sudden natural disaster. A devastating earthquake often causes very serious economic losses and casualties in a very short time. Most of the losses and casualties are caused by the destruction of the building in the earthquake. Especially in the traditional old buildings in remote areas of China, most of them use brick walls or adobe structures without earthquake resistance measures. Many buildings are easily destroyed and collapse in an earthquake and the damage of the earthquake is particularly serious.

In the prior technology, the earthquake resistance modification of existing buildings normally has two measures, one is the structural strengthening, the other is the foundation shock absorption. Wherein, the structural strengthening is to improve the earthquake resistance performance of the structural members by improving the strength and deformation capacity of the structural members. For example, implanting steel bars into the walls of buildings to improve the structural stiffness of the walls. The foundation shock absorption is to provide a shock-absorbing structure under the foundation of the entire building. For example, lifting the foundation of the entire building and then placing dampers and so on.

However, for the traditional old brick walls or adobe structure walls, one aspect of the earthquake resistance strengthening method of the bonded rebars of walls is that the material and construction cost is much higher than the overall value of the traditional old building. It is better to push down and rebuild. The other aspect is that the weight of the walls structure increases after the walls is strengthened, and after the walls collapses in the earthquake, the threat to personal safety is greater. Therefore, the economic and social benefits of adopting structural strengthening measures for the existing traditional old buildings are very low. The construction of the basic shock absorption measures is very difficult and costly. They are generally only suitable for buildings with special historical and economic value. For traditional old buildings in existing remote areas, the basic shock absorption has little practical significance.

Therefore, at the present stage, for earthquake disaster reduction and emergency management, there is an urgent need to provide a low-cost solution for a large-scale earthquake resistance reconstruction of existing buildings with traditional old brick walls or adobe structures to reduce economic losses and casualties caused by the earthquake.

SUMMARY OF THE INVENTION

The technical problem to be solved by the present invention is to provide a building earthquake resistance structure and earthquake resistance method to reduce or avoid the problems mentioned above.

In order to solve the above technical problems, the invention provides a building earthquake resistance structure, which is used for the earthquake resistance treatment of an existing building, wherein the building earthquake resistance structure comprises: an integrally connected roof support frame, used for supporting a roof of a building to be independent from walls of the building; a plurality of support columns, fixedly connected to the roof support frame by joint bearings; an annular trench, arranged in the ground around the building; an annular damping frame, arranged within the annular trench, the lower ends of the support column being fixedly connected to the annular damping frame through joint bearings; a plurality of dampers, arranged between a bottom portion of the annular trench and the annular damping frame.

Preferably, a first groove is disposed under the annular damping frame, and at the bottom portion of the annular trench is provided with a second groove corresponding to the first groove; the upper surface and lower surface of the damper can be restricted to move horizontally within the range of the first groove and the second groove respectively.

Preferably, the damper is a cylindrical rubber pad with a through-hole penetrating through the upper and lower bottom surfaces, and the through-hole is internally provided with a steel ball whose diameter is smaller than the thickness of the uncompressed rubber pad.

Preferably, at the two edges of the second groove with the largest spacing are respectively provided with a downward water leakage hole, and the water leakage hole is communicated with a pumping well through water channels, and the pumping well is provided with a water pumping pipe connected with a water pump.

Preferably, the upper part of the annular trench is covered with a waterproof cover.

The present invention also provides a building earthquake resistance method, for performing earthquake resistance treatment of an existing building, wherein the method comprises the following steps: providing an integrally connected roof support frame to support the roof of a building to be independent from the walls of the building; excavating an annular trench in the ground around the building; disposing a plurality of dampers on the bottom of the annular trench; disposing an annular damping frame above the damper; connecting a plurality of support columns fixedly to the annular damping frame via joint bearings; lifting the roof support frame together with the roof of the building by a crane; rotating the support column so that the upper ends of the support column is fixedly connected with the roof support frame through joint bearings, and using the support columns to support the roof of the building to be independent from the walls of the building.

Preferably, when excavating the annular trench, the bottom of the annular trench is provided with a water leakage hole and a water channel connected with a pumping well.

Preferably, a circular second groove is provided at the bottom of the annular trench for horizontal movement of the damper within its range, and at the two edges of the diameter of the second groove are respectively provided with a water leakage hole.

Preferably, a circular first groove corresponding to the second groove is disposed under the annular damping frame.

Preferably, the first groove and the second groove have the same diameter.

The building earthquake resistance structure and earthquake resistance method of the present invention is that it supports the roof of the existing building on the ground by supporting parts, which can avoid the loss caused by roof collapse during the earthquake. The earthquake resistance structure is easy to construct, especially suitable for the reconstruction of traditional old buildings, with high economic and social benefits and easy to promote and use.

DESCRIPTION OF THE DRAWINGS

The following drawings are only for the purpose of description and explanation but not for limitation. Wherein.

DESCRIPTION OF PREFERRED EMBODIMENT

Figure 1:
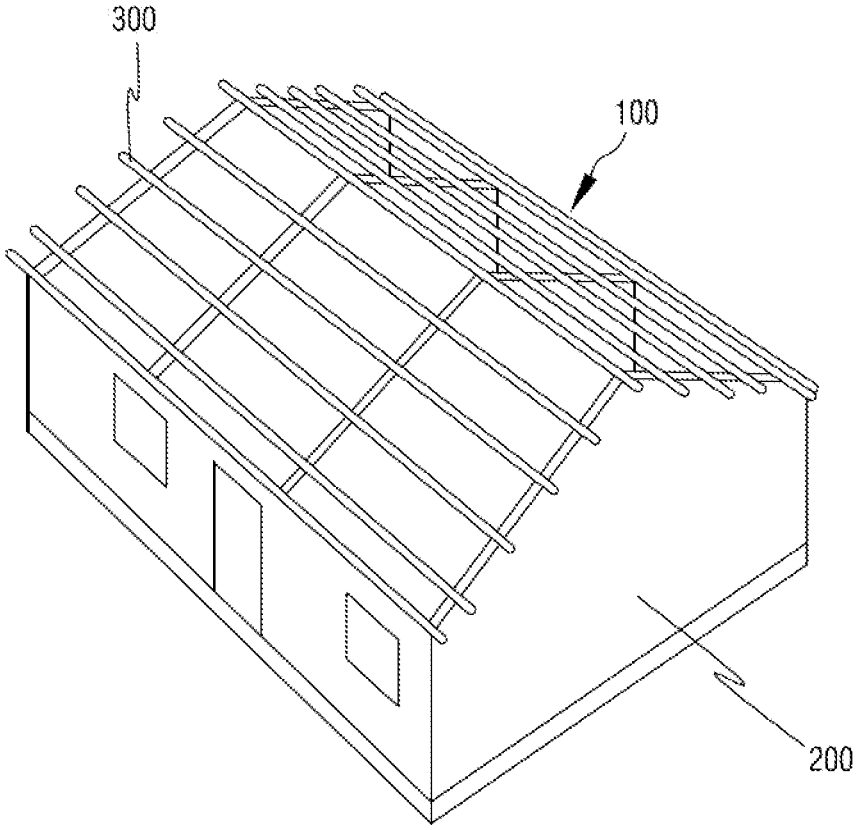
FIG. 1 shows a schematic diagram of the structure of an existing building.

In order that the present invention can be more readily understood, reference will now be made to the accompanying drawings to illustrate the embodiments of the present invention. Wherein, the same components have been marked with the same reference numerals.

As shown in FIG. 1, it shows a schematic diagram of the structure of an existing building, which is a typical traditional old structure building. Roof 100 of the building does not show the outermost tiles and other structures, and only a few wooden beams 300 placed on walls 200 are schematically shown. Due to the lack of suitable timber for the walls, walls 200 of traditional and old buildings in China are generally brick walls or adobe. As described in the background, if the existing building shown in FIG. 1 is reconstructed with the existing technologies, its economic and social benefits are very low. Accordingly, aiming at this technical problem, the present invention provides a low-cost solution, which is used to carry out the large-scale earthquake resistance reconstruction of existing buildings with traditional old brick walls or adobe structures, so as to reduce economic losses and casualties caused by earthquakes.

Specifically, the solution of the present invention is to support roof 100 of the existing building to be on the ground independent from walls 200 through the supporting parts. When the earthquake occurs, because supported by the shock-absorbing structure of the supporting parts, roof 100 will not collapse, thereby reducing the death of people due to the collapse of roof 100 and reducing the property loss caused by the damage of roof 100. In addition, the well-preserved roof 100 can provide basic shelter and prevent the victims from sleeping on the streets after an earthquake, and walls 200 can be quickly repaired under roof 100. It is conducive to post-disaster reconstruction.

In short, due to the structural characteristics of the traditional old buildings in remote areas, the structural strength of walls 200 is insufficient and it is easy to collapse in an earthquake. However, since the height of these traditional old buildings is very small, the collapse of walls 200 usually does not cause much damage. Conversely, after the collapse of walls 200, the wooden beam 300 on roof 100 is likely to cause death. Therefore, by supporting roof 100, the present invention can avoid the loss caused by the collapse of roof 100.

Figure 2:
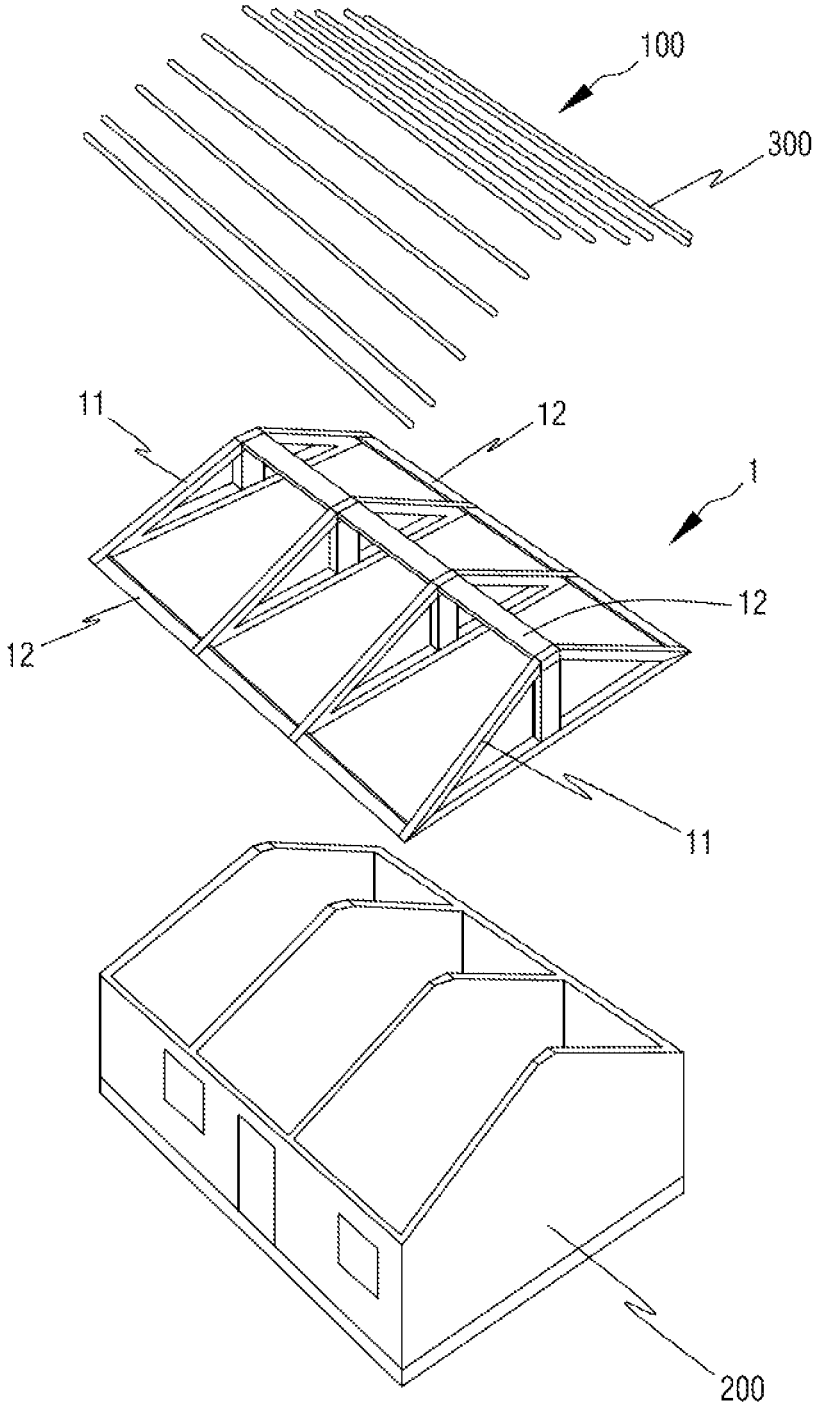
FIG. 2 shows a decomposition schematic diagram of a roof support structure according to a specific embodiment of the present invention.

In order to facilitate supporting roof 100 on the ground to be independent from walls 200 by the supporting parts, at first, we should provide a support structure to support the whole roof 100. FIG. 2 shows a decomposition schematic diagram of a roof support structure according to a specific embodiment of the present invention. The figure shows that under roof 100 of the existing building, an integrally connected roof support frame 1 is additionally provided, which is preferably adopted with a steel welded structure. As shown in the figure, roof support frame 1 includes a triangular roof truss 11 arranged adjacent to each of the sidewalls, and a transverse connector 12 connecting the vertices of each triangular roof truss 11 together. Roof support frame 1 in FIG. 2 shows a simple structure that can be designed in other forms according to different building structures, as long as roof 100 can be supported independent from walls 200 of the building.

Figure 3:
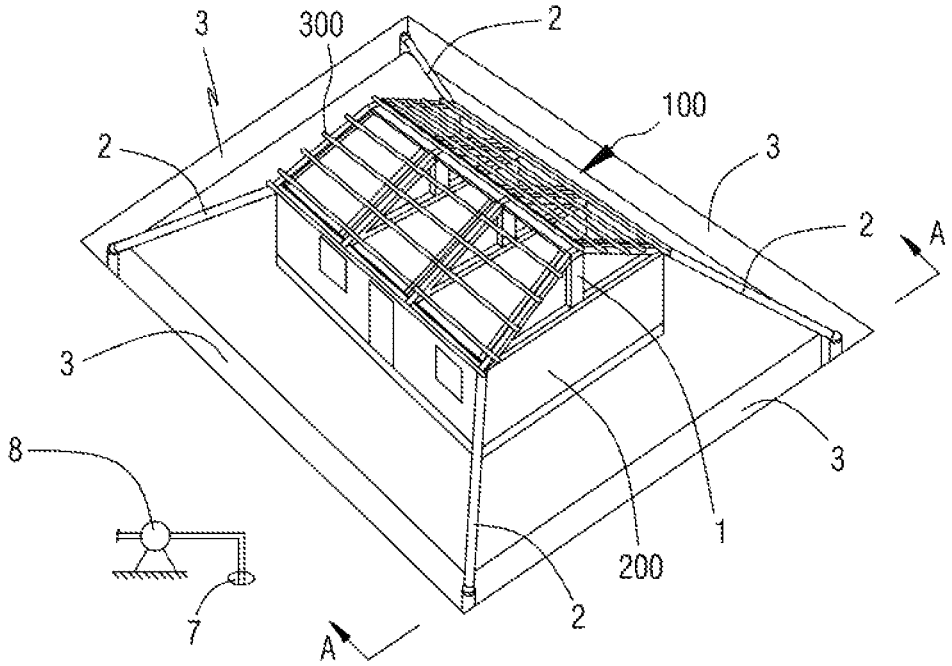
FIG. 3 shows a schematic view of a building earthquake resistance structure according to another specific embodiment of the present invention.

FIG. 3 shows a schematic view of a building earthquake resistance structure according to another specific embodiment of the present invention. Roof 100 of the building shown in the figure has been supported independent from walls 200 by the roof support frame 1 shown in FIG. 2. As shown in FIG. 3, the building earthquake resistance structure of the present invention can be used for earthquake resistance treatment of an existing building. The building earthquake resistance structure comprises: the integrally connected roof support frame 1 as shown in FIG. 2, used for supporting roof 100 of the building to be independent from walls 200 of the building. In addition, a plurality of support columns 2 are fixedly connected to the roof support frame 1 by joint bearings (not shown). In the specific embodiment shown in FIG. 3, each of the four corners of the building is provided with a support column 2. Further, the building earthquake resistance structure of the present invention comprises an annular trench 3 arranged in the ground around the building. The lower end of support column 2 is connected with the shock-absorbing structure arranged in annular trench 3, to isolate the influence of ground vibration on support column 2 and at the same time to provide further cushioning and shock absorption for support column 2 through the shock-absorbing structure.

Figure 4:
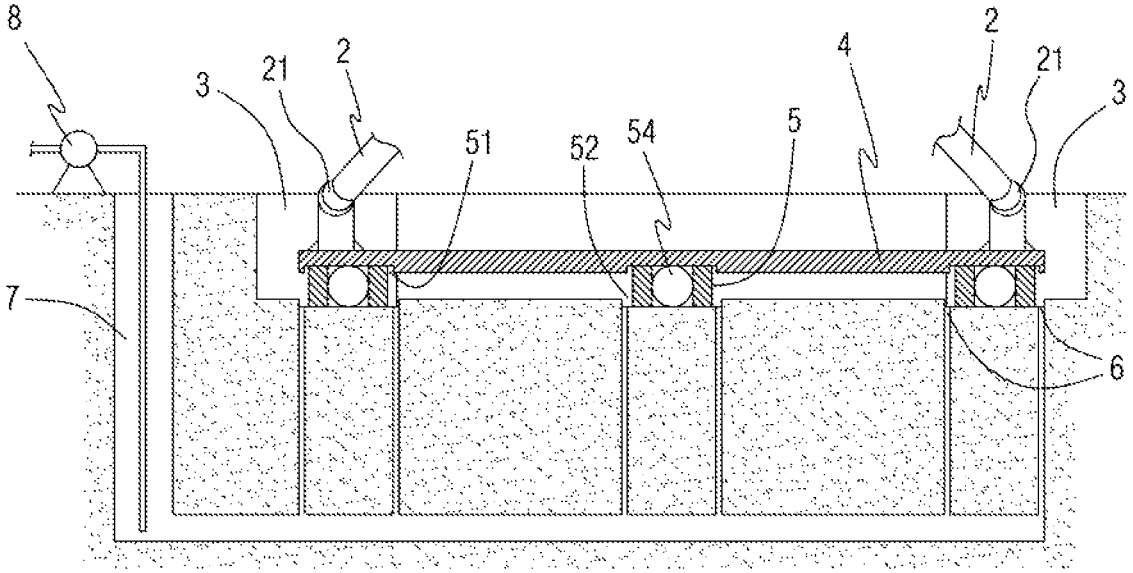
FIG. 4 shows the A-A sectional view as shown in FIG. 3.

The shock-absorbing structure in annular trench 3 will be described in detail below according to FIG. 4, wherein FIG. 4 shows the A-A sectional view as shown in FIG. 3. The figure shows that an annular damping frame 4 is arranged within annular trench 3, and the lower ends of support column 2 are fixedly connected to annular damping frame 4 through joint bearings 21. Further, a plurality of dampers 5 are provided between the bottom of the annular trench 3 and the annular damping frame 4. When an earthquake occurs, the annular damping frame 4 used to connect the support column 2 can move as a whole relative to the ground under the support of the damper 5. By the buffer of the damper 5, the impact of the seismic wave on the support column 2 can be reduced, and the stability of the roof 100 above the support column 2 can be maintained, thereby can keep the roof 100 from collapsing.

Figure 5:
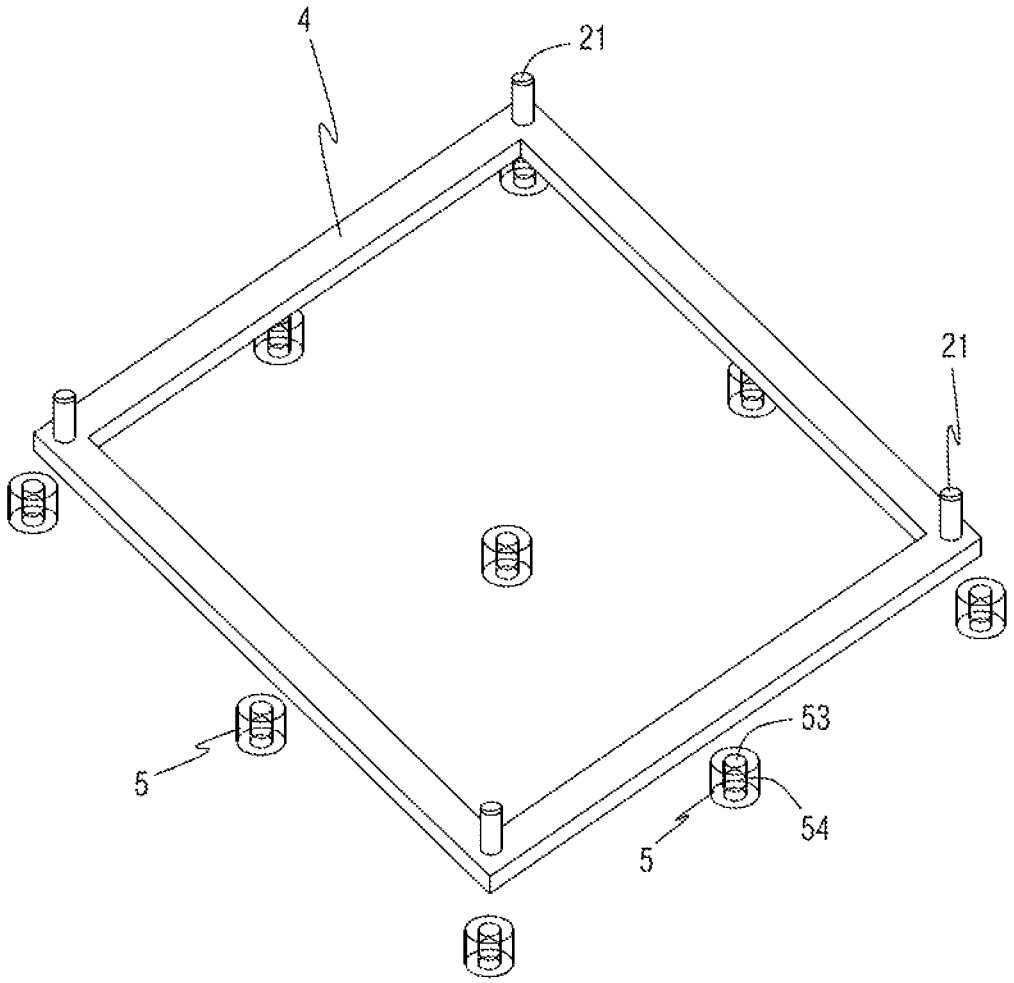
FIG. 5 shows a schematic diagram of the structure of an annular damping frame according to another specific embodiment of the present invention.

FIG. 5 shows a schematic diagram of the structure of an annular damping frame according to another specific embodiment of the present invention, which can show the overall structure of the annular damping frame 4 provided in the annular trench 3. In the specific embodiment illustrated in FIG. 3-5, the annular trench 3 is designed as a rectangular structure according to the style of the building. Corresponding to the rectangular structure of the annular trench 3, the annular damping frame 4 provided in the annular trench 3 is also rectangular. Of course, those skilled in the art should understand that according to actual needs, the annular trench 3 and the annular damping frame 4 can also be designed as other polygons or circles, as long as the annular trench 3 can provide sufficient shock absorption space for the annular damping frame 4. On one hand, the annular trench 3 of the present invention can separate the connection between the foundation of the building and the ground, which reduces the horizontal impact of the earthquake; on the other hand, the shock absorption structure can be conveniently set in the annular trench 3 to hide the shock absorption structure under the ground, which avoids obstacles to people when enters and leaves the building. It is especially important that the annular trench 3 can be easily constructed around the building, and does not need to touch the foundation, walls and other structures of the building. It is particularly suitable for the reconstruction of traditional old buildings, with simple operation, low cost, high economic and social benefits, and easy to promote and use.

In a specific embodiment of the present invention, a first groove 51 is disposed under the annular damping frame 4. At the bottom portion of the annular trench 3 is provided with a second groove 52 corresponding to the first groove 51. The upper surface and lower surface of the damper 5 can be restricted to move horizontally within the range of the first groove 51 and the second groove 52 respectively. Preferably, both the first groove 51 and the second groove 52 may be arranged in a circular shape, with corresponding positions to each other and have the same diameter, so that the same horizontal movement range for the damper 5 can be provided. The first groove 51 and the second groove 52 can be used to restrict the horizontal movement of the damper 5 within a certain range, to avoid the support structure being uneven due to the excessive displacement of the damper 5 results from the impact of the earthquake. That is, in the case of frequent earthquakes, the position of the damper 5 will move, if there is no restriction, some dampers 5 may gather on one side of the annular damping frame 4, which may cause the annular damping frame 4 tilting and failure. But by the first groove 51 and the second groove 52 with limited position movement function can prevent this situation occur.

Further, in another specific embodiment, as shown in FIG. 4 and FIG. 5, the damper 5 can be a cylindrical rubber pad with a through-hole 53 penetrating through the upper and lower bottom surfaces, and the through-hole 53 is internally provided with a steel ball 54 whose diameter is smaller than the thickness of the uncompressed rubber pad. The damper 5, with the form of a cylindrical rubber pad, has elasticity and can be compressed so that the vertical impact of the earthquake can be reduced. The steel ball 54 can provide a certain support force when the rubber pad is compressed, so as to avoid the rubber pad cracking due to excessive force, which can improve the service life of the rubber pad. When subjected to the horizontal impact of the earthquake, the steel ball 54 can easily roll, the rolling steel ball 54 extrudes the inner wall of the through-hole 53, which makes the rubber pad laterally deform, thereby absorbs the horizontal impact by lateral deformation of the rubber pad. The damper 5 of the present invention has a simple structure and is easier to manufacture compared with the existing damping structure of the laminated structure. It is particularly suitable for the low-cost shock absorbing structure of the present invention.

In addition, in order to prevent the shock-absorbing structure from being eroded by rainwater, at the two edges of the second groove 52 with the largest spacing are respectively provided with a downward water leakage hole 6. The water leakage hole 6 is communicated with a pumping well 7 through water channels, and the pumping well 7 is provided with a water pumping pipe connected with a water pump 8. When the second groove 52 is circular, the two water leakage holes 6 are respectively disposed at both edges of the diameter of the second groove 52, so that when the damper 5 moves, there is always a water leakage hole 6 that will not be blocked by the damper 5, so as to avoid rainwater gathering in the second groove 52.

Preferably, the upper part of the annular trench 3 is further covered with a waterproof cover. The waterproof cover can be used to prevent rainwater from entering the annular trench 3 on one hand. On the other hand, it can shield the annular trench 3 to avoid damage caused by people or objects falling into the annular trench 3. Preferably, the waterproof cover is made of a stainless steel plate. It can bear the weight of people and vehicles, to facilitate the daily pass for the householder and other people.

The building earthquake resistance method of the present invention will be further described below with reference to the accompanying drawings. The method is used for performing earthquake resistance treatment of an existing building, wherein the method comprises the following steps:

Providing an integrally connected roof support frame 1 to supporting the roof 100 of the building independent from the walls 200 of the building; excavating an annular trench 3 in the ground around the building; and disposing a plurality of dampers 5 on the bottom of the annular trench 3; disposing an annular damping frame 4 above the damper 5; connecting a plurality of support columns 2 fixedly to the annular damping frame 4 via joint bearings 21; and lifting the roof support frame 1 together with the roof 100 of the building by a crane; rotating the support column 2 so that the upper ends of the support column 2 is fixedly connected with the roof support frame 1 through joint bearings (not shown in the figure); and using the support columns 2 to support the roof 100 of the building to be independent from the walls 200 of the building.

Preferably, when excavating the annular trench 3, the bottom of the annular trench 3 is provided with a water leakage hole 6 and a water channel communicated with a pumping well 7.

The improvement and deformation of other structures involved in the building seismic method of the present invention can be referred to the various embodiments and their combinations of the building seismic structures in the above-mentioned embodiments, and they will not be described in detail here.

The skilled person in the art should understand that, although the present invention has been described with multiple embodiments, each embodiment does not include only one independent technical solution. It is only for the purpose of clarity to describe like that, the person in the art should understand the specification as a whole and the technical solutions in all embodiments can be inter combined with each other to form the protection scope of the present invention.

Whilst the above description has been given by way of illustrative examples of the present invention, but it is not for limitation of the scope of the invention. Variations and modifications thereto will be apparent to those skilled in the art without departing from the broad ambit and scope of the invention as herein set forth in the following claims.

The invention claimed is:

1. A building earthquake resistance structure, which is used for the earthquake resistance treatment of an existing building, wherein the building earthquake resistance structure comprises:

an integrally connected roof support frame, used for supporting a roof of a building to be independent from walls of the building;

a plurality of support columns, fixedly connected to the roof support frame by joint bearings;

an annular trench, arranged in the ground around the building;

an annular damping frame, arranged within the annular trench, the lower ends of support column being fixedly connected to the annular damping frame through joint bearings; and a plurality of dampers, provided between the bottom portion of the annular trench and the annular damping frame.

2. The building earthquake resistance structure according to claim 1, wherein a first groove is disposed under the annular damping frame, and at the bottom portion of the annular trench is provided with a second groove corresponding to the first groove; the upper surface and lower surface of the damper can be restricted to move horizontally within the range of the first groove and the second groove respectively.

3. The building earthquake resistance structure according to claim 2, wherein the damper is a cylindrical rubber pad with a through-hole penetrating through the upper and lower bottom surfaces, and the through-hole is internally provided with a steel ball whose diameter is smaller than the thickness of the uncompressed rubber pad.

4. The building earthquake resistance structure according to claim 2, wherein the second groove is provided with a downward water leakage hole, and the water leakage hole is communicated with a pumping well through water channels, and the pumping well is provided with a water pumping pipe connected with a water pump.

5. The building earthquake resistance structure according to claim 2, wherein the upper part of the annular trench is covered with a waterproof cover.

6. The building earthquake resistance structure according to claim 1, wherein the damper is a cylindrical rubber pad with a through-hole penetrating through the upper and lower bottom surfaces, and the through-hole is internally provided with a steel ball whose diameter is smaller than the thickness of the uncompressed rubber pad.

7. The building earthquake resistance structure according to claim 6, wherein the upper part of the annular trench is covered with a waterproof cover.

8. The building earthquake resistance structure according to claim 1, wherein the second groove is provided with a downward water leakage hole, and the water leakage hole is communicated with a pumping well through water channels, and the pumping well is provided with a water pumping pipe connected with a water pump.

9. The building earthquake resistance structure according to claim 8, wherein the upper part of the annular trench is covered with a waterproof cover.

10. The building earthquake resistance structure according to claim 1, wherein the upper part of the annular trench is covered with a waterproof cover.

11. A building earthquake resistance method, for performing earthquake resistance treatment of an existing building, wherein the method comprises the following steps:

providing an integrally connected roof support frame to support the roof of a building to be independent from the walls of the building;

excavating an annular trench in the ground around the building;

disposing a plurality of dampers on the bottom of the annular trench;

disposing an annular damping frame above the damper;

connecting a plurality of support columns fixedly to the annular damping frame via joint bearings;

lifting the roof support frame together with the roof of the building by a crane;

rotating the support column so that the upper ends of the support column is fixedly connected with the roof support frame through joint bearings, and using the support columns to support the roof of the building to be independent from the walls of the building.

12. The method according to claim 11, when excavating the annular trench, the bottom of the annular trench is provided with a water leakage hole and a water channel communicated with a pumping well.

13. The method according to claim 12, wherein a circular trench groove is provided at the bottom of the annular trench for restricting horizontal movement of the damper, and the second groove is provided with at least one water leakage hole.

14. The method according to claim 13, wherein a circular damping frame groove corresponding to the circular trench groove is disposed under the annular damping frame.

15. The method according to claim 14, wherein the damping frame groove and the circular trench groove have the same diameter.

* * * * *